US006082284A

United States Patent [19]

McCabe

[11] Patent Number: 6,082,284

[45] Date of Patent: Jul. 4, 2000

[54] ANCHOR

[75] Inventor: Curt McCabe, Houston, Tex.

[73] Assignee: Vrijhof Ankers Beheer B.V., Netherlands

[21] Appl. No.: 09/085,892

[22] Filed: Apr. 17, 1998

Related U.S. Application Data

[63] Continuation-in-part of application No. 08/743,466, Nov. 4, 1996, abandoned.

[51] Int. Cl.[7] ..... B63B 21/32

[52] U.S. Cl. ..... 114/301

[58] Field of Search ..... 37/454, 455; 114/294, 114/301–308

[56] References Cited

U.S. PATENT DOCUMENTS

| | | | |
|---|---|---|---|
| 3,026,947 | 3/1962 | Larson et al. | 37/455 |
| 4,802,434 | 2/1989 | Bruce | 114/301 |
| 5,353,732 | 10/1994 | Gramet et al. | 114/304 |

FOREIGN PATENT DOCUMENTS

| | | | |
|---|---|---|---|
| 220758 | 5/1987 | European Pat. Off. | 114/301 |

*Primary Examiner*—Ed Swinehart

*Attorney, Agent, or Firm*—Williams, Morgan & Amerson

[57] ABSTRACT

The present invention provides a marine anchor that provides a high holding power and allows faster, smoother and more controlled penetration of the anchor in various soil types. The invention includes an anchor with a shank having two, rearwardly diverging legs that are coupled to the top surface of the fluke along two rearwardly diverging lines so that the plate-like legs define a soil passage that diverges rearwardly within all planes that are parallel to the surface of the fluke between the legs. The fluke preferably includes two primary fluke points disposed on either side a central fluke axis and a third fluke point disposed along the central fluke axis to break up the soil passing over the fluke and between the shank legs. The fluke also incorporates a forwardly tapering profile with a ridge aligned with each fluke point, wherein the fluke is also tapered between each ridge so that the side-to-side cross-section of the fluke has multiple hills and valleys therein. It is preferred that the fluke further include a back edge that is rearwardly tapering.

33 Claims, 7 Drawing Sheets

ANCHOR

This application is a CIP Ser. No. 08/743,466 filed Nov. 4, 1996, abandoned.

BACKGROUND OF THE INVENTION

1. Field of the Invention

The present invention relates generally to marine anchors, and more particularly to drag embedment anchors.

2. Background of the Related Art

Drag embedment anchors are generally comprised of two major components, a fluke and a shank. Generally, the fluke is relatively flat and has a large surface area, with two pointed front tips which penetrate the soil on the sea floor as the anchor is dragged. When the anchor is completely embedded in the soil on the sea floor, the pressure of the soil on the fluke is a major component of the holding power of the anchor. A typical fluke is formed from a flat plate stiffened by external ribs, or from a wedged-shaped box stiffened by internal ribs.

The shank is generally a long, thin member which is fastened near the stern of the fluke at one end, and to a mooring line at the other end. In most anchors, the shank is coincident with the central longitudinal axis of the fluke when the anchor is viewed from above. The shank serves to transmit forces between the fluke and the mooring line.

There are two broad categories of drag embedment anchors within which most anchors can be classified. The first category includes traditional or swing shank anchors. Traditional anchors have shanks which are straight and rotatably secured to the fluke at a single hinge point so that the shank can pivot to a limited degree on either side of the fluke. As the anchor is dragged along the sea floor, one side of the fluke will face downward, toward the sea floor. Once the fluke tips penetrate the soil, the shank will swing to the other side of the fluke. Since either side of the fluke can be facing downward, the fluke must be symmetrical in shape.

The second broad category of anchors includes the modern, or fixed shank type. The flukes of these anchors have a defined top surface and underside since the attitude of the shank is fixed relative to the fluke during operation. The shank extends upwardly from the top surface of the fluke. In order to penetrate the soil, these anchors must either land on the sea floor with the fluke beneath the shank and with the fluke's bottom side resting on the sea floor or be designed to achieve this position upon dragging. In order to achieve a high holding power, the anchor must deeply penetrate the soil to a depth where the anchor is securely held. Conversely, the anchor should not penetrate so deeply that the anchor cannot be retrieved.

Anchor designs of both types may be adjusted to accommodate varying soil conditions. The altitude of the shank relative to the fluke should be changed to assist the initial penetration and ultimate depth of the flukes within the soil. The softer the soil is, the greater the attitude should be. However, the means for adjusting the fluke opening angle on previous anchors have suffered from various drawbacks. In swing shank anchors, this angle can be varied by fastening a stopper to the fluke which limits the rotation of the shank past a certain point. However, the stopper is removed when a wide fluke opening angle is desired, and must be stored and handled when not in use. Further, the weight of the stopper reduces efficiency of the anchor when the stopper is in use. Fixed shank anchors may not have an adjustment option or the adjustment may require laborious procedures for securing the shank to the fluke.

An important parameter for measuring anchor performance is the holding efficiency, or the ratio of the holding power to the weight of the anchor. Fixed shank anchors typically have greater holding efficiencies than swing shank anchors which are unnecessarily heavy due the symmetry of the fluke. However, as the holding efficiency of fixed shank anchors increases, the strength of the anchors must be maintained or increased accordingly. In U.S. Pat. No. 5,353,732, Gramet et al. disclose a shank having two parallel legs that are strengthened by stiffening ribs and a stiffening plate. In U.S. Pat. No. 4,397,256, Bruce also discloses a shank having two parallel legs, but with multiple stiffening plates disposed at a positive attack angle to contribute to burial of the anchor. Furthermore, a V-shaped twin shank is disclosed by van den Haak in U.S. Pat. No. 4,706,595 having pairs of crossing elements between the shank legs to increase rigidity.

The performance of the fluke is also a very important determinant of holding efficiency and drag distance. The two fluke tips of a drag embedment anchor are typically coextensive and symmetrically disposed on either side of the fluke axis in order to promote penetration of the anchor. The fluke may have a substantially flat profile or a hollow, wedge-shaped profile, as disclosed by Gramet et al. in U.S. Pat. No. 5,353,732. In U.S. Pat. No. 3,964,421, van den Haak discloses a hollow fluke having longitudinal supporting ribs between the plates forming the top and bottom surfaces of the fluke to increase the strength of the fluke.

However, despite the forgoing developments, there is still a need for a drag embedment anchor that provides an even higher holding efficiency. More particularly, there is a need for a drag embedment anchor that allows faster, smoother and more controlled penetration of the anchor in various soil types. It would be desirable if the anchor could achieve penetration over much shorter drag distances. It would also be desirable if the anchor provided an adjustable angle between the shank and the fluke to allow a single anchor to be used in various soil types.

SUMMARY OF THE INVENTION

The present invention provides an anchor, comprising a fluke and a shank having two legs with first ends coupled to the fluke, the legs being rearwardly diverging to form a passage of rearwardly increasing cross-sectional area. Preferably, the fluke has a top surface that is substantially planar and the shank legs comprise a transverse member disposed between the legs in an inclined plane rearwardly diverging from the plane of the top fluke surface. A plurality of transverse members may be disposed between the legs to form a plurality of passages with rearwardly increasing cross-sectional area. Typically, the shank legs are substantially flat and, optionally, include a cradle notch.

The invention also provides an anchor comprising a hollow, forwardly tapering fluke having three or more fluke tips and a shank having a pair of legs coupled to the fluke. The fluke preferably includes a forwardly tapering ridge aligned with each fluke tip and a tapered fluke surface between each ridge. A particularly preferred anchor comprises a top fluke surface that is substantially planar, a back edge that is rearwardly tapering, and one fluke tip that is shorter than at least one other fluke tip.

The invention also provides an anchor comprising a hollow, forwardly tapering fluke having a front edge with two or more fluke tips and a rearwardly tapering back edge; and a shank having two legs and a transverse member disposed between the two legs, each leg having a first end coupled to the fluke and a second end coupled to a lug, and wherein the legs are rearwardly diverging to form a passage of rearwardly increasing cross-sectional area. Most preferably, the shank legs are coupled to the substantially planar top surface of the fluke along nonparallel, rearwardly diverging paths and the shank and fluke have an adjustable angular coupling therebetween for forming an angle between about 10 and about 20 degrees. Furthermore, the transverse member is preferably rearwardly diverging from the top surface of the fluke.

In accordance with the present invention, it is preferred that the shank legs be coupled to the lug in a spaced apart relation. Furthermore, it is preferred that the anchor further comprise a pair of stabilizers coupled to the sides of the fluke and a shank depressor extending outwardly from each shank leg. The hollow fluke is made stronger by the use of triangular ribs therein.

BRIEF DESCRIPTION OF THE DRAWINGS

The above and other advantages of the present invention are described in conjunction with the following drawing figures, in which.

DESCRIPTION OF A PREFERRED EMBODIMENT

The present invention provides a marine anchor that provides a high holding power. More particularly, the present invention provides a drag embedment anchor that allows faster, smoother and more controlled penetration of the anchor in various soil types. Penetration of the anchor into the soil is smoother, more controlled and achieved over much shorter drag distances than existing drag embedment anchors. The anchor also allows the angle between the shank and the fluke to be adjusted according to the type of soil in which the anchor is to be secured.

In one aspect of the invention, an anchor is provided with a shank having two, rearwardly diverging legs that are coupled to the top surface of the fluke along two rearwardly diverging lines. Furthermore, it is preferred that the plate-like legs define a soil passage that diverges rearwardly within all planes that are parallel to the surface of the fluke between the legs. The legs may include various struts disposed therebetween to strengthen the shank, but the struts are preferably narrow and arranged so that no two struts are placed in the same linear path of the soil.

In another aspect of the invention, an anchor is provided with a fluke having three or more generally triangular shaped tips. Two primary fluke points are disposed on either side of a central fluke axis to achieve initial penetration of the soil surface and break up the soil passing in contact with the anchor. A third fluke point is disposed along the central fluke axis to further break up the soil passing over the fluke and between the shank legs. Additionally, the third fluke point increases the total surface area of the fluke which adds to the holding power of the anchor. It is preferred that each of the fluke tips include a pointed fluke tip extending forward of the fluke point.

In yet another aspect of the invention, an anchor is provided with a fluke having a stealth-shaped profile. The fluke has a forwardly tapering profile with a ridge aligned with each fluke point. The fluke is also tapered between each ridge so that the side-to-side cross-section of the fluke has multiple hills and valleys therein. It is preferred that the fluke further include a back edge that is rearwardly tapering toward the top surface of the fluke. It is also preferred that the fluke include a substantially flat top surface, particularly between the legs of the shank.

Figure 1:
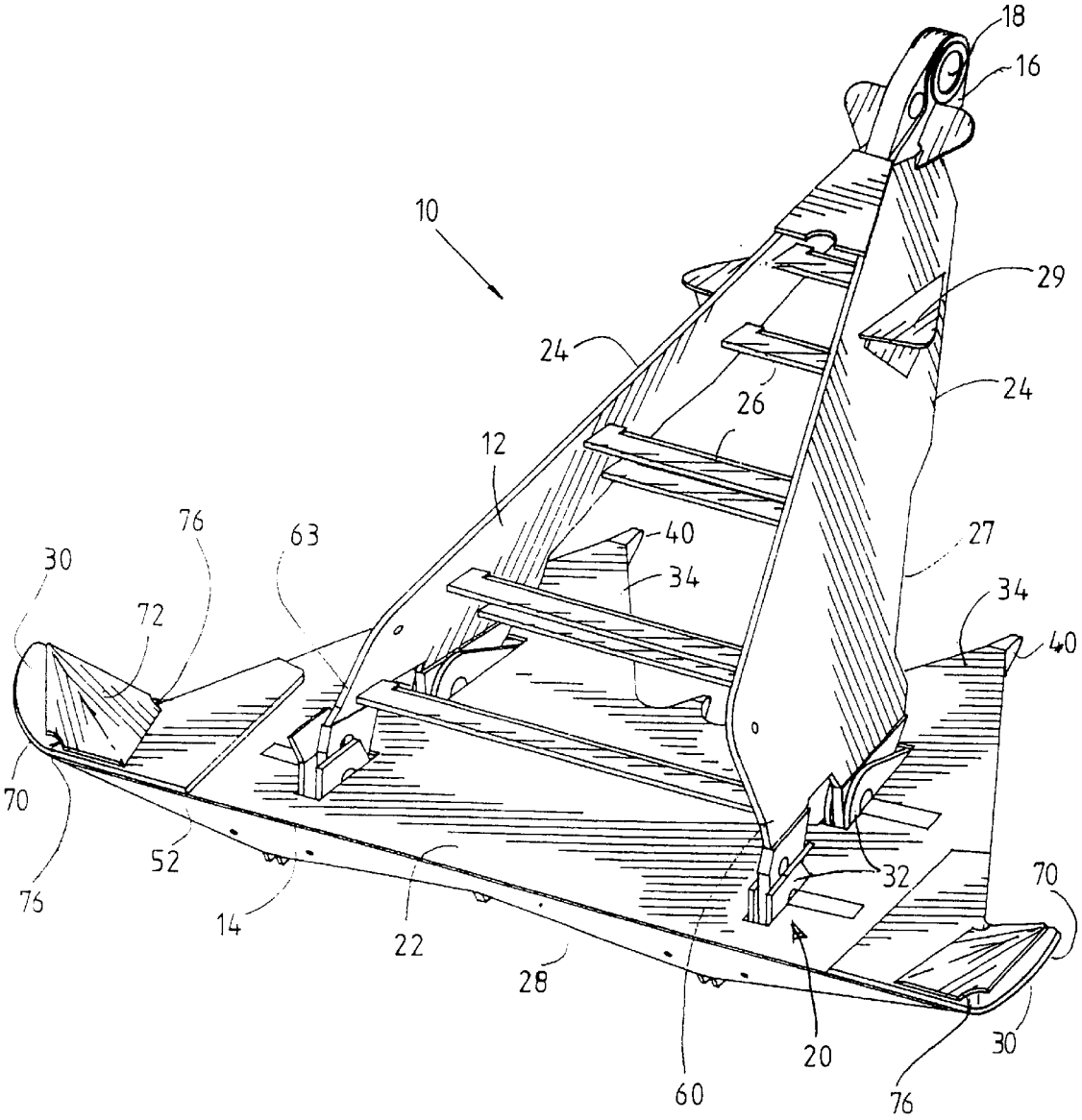
FIG. 1 is a perspective view of a drag embedment anchor of the present invention.

Now referring to FIG. 1 is a perspective view of a drag embedment anchor 10 of the present invention is shown. The anchor 10 generally comprises a shank 12 and a fluke 14. The shank 12 includes a first end having a lug 16 with an eyelet 18 for attachment to a mooring line (not shown) and a second end having an adjustable assembly 20 for pivotal coupling to the top surface 22 of the fluke 14. The two shank legs 24 are provided with stiffeners 26 therebetween. It is preferred that the shank include a pair of anchor depressor wings 29 attached to the exterior faces of the shank legs 24. The shanks may also include an optional notch 27 near the base of the shank in order to be more securely supported on the anchor cradles of a vessel or rig being secured. The notch 27 is sized to be received by the anchor cradle.

Figure 3:
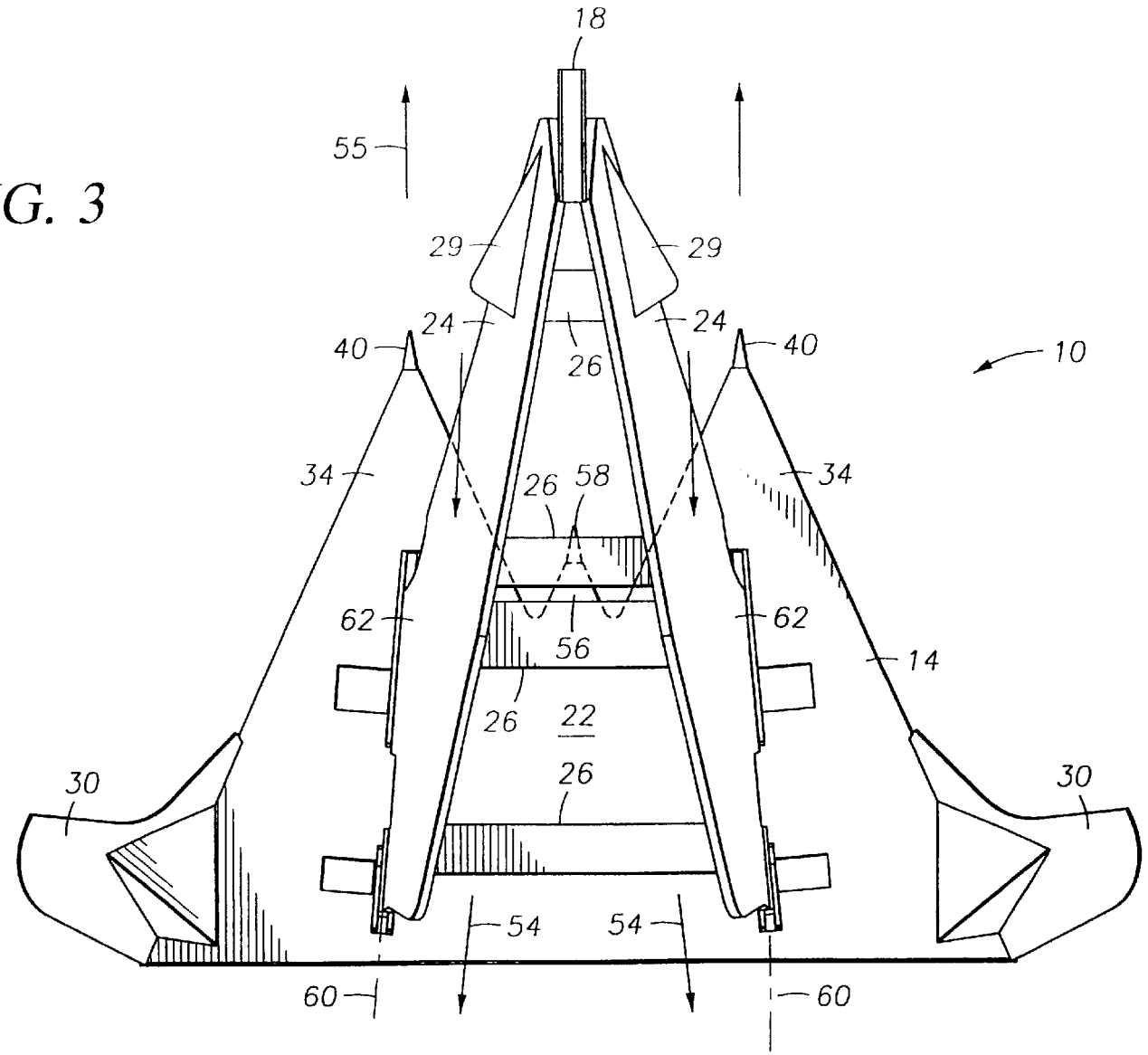
FIG. 3 is a top view of the anchor showing the attachment of the shank to the fluke and the rearwardly diverging passage through the shank.

The fluke 14 includes a substantially flat top surface 22, a stealth-shaped bottom surface 28 (See FIG. 4), a shank receiving assembly 32 and fluke points 34 having fluke tips 40 (See also FIG. 3). The fluke 14 is preferably of hollow construction to minimize weight and maximize surface area. It is preferred that the fluke 14 include stabilizers 30, which are generally wing-like structures with a wedge-shaped profile that assists the anchor in maintaining an upright position. Furthermore, the anchor has a center of gravity that allows it to land upright on the sea floor.

Figure 2:
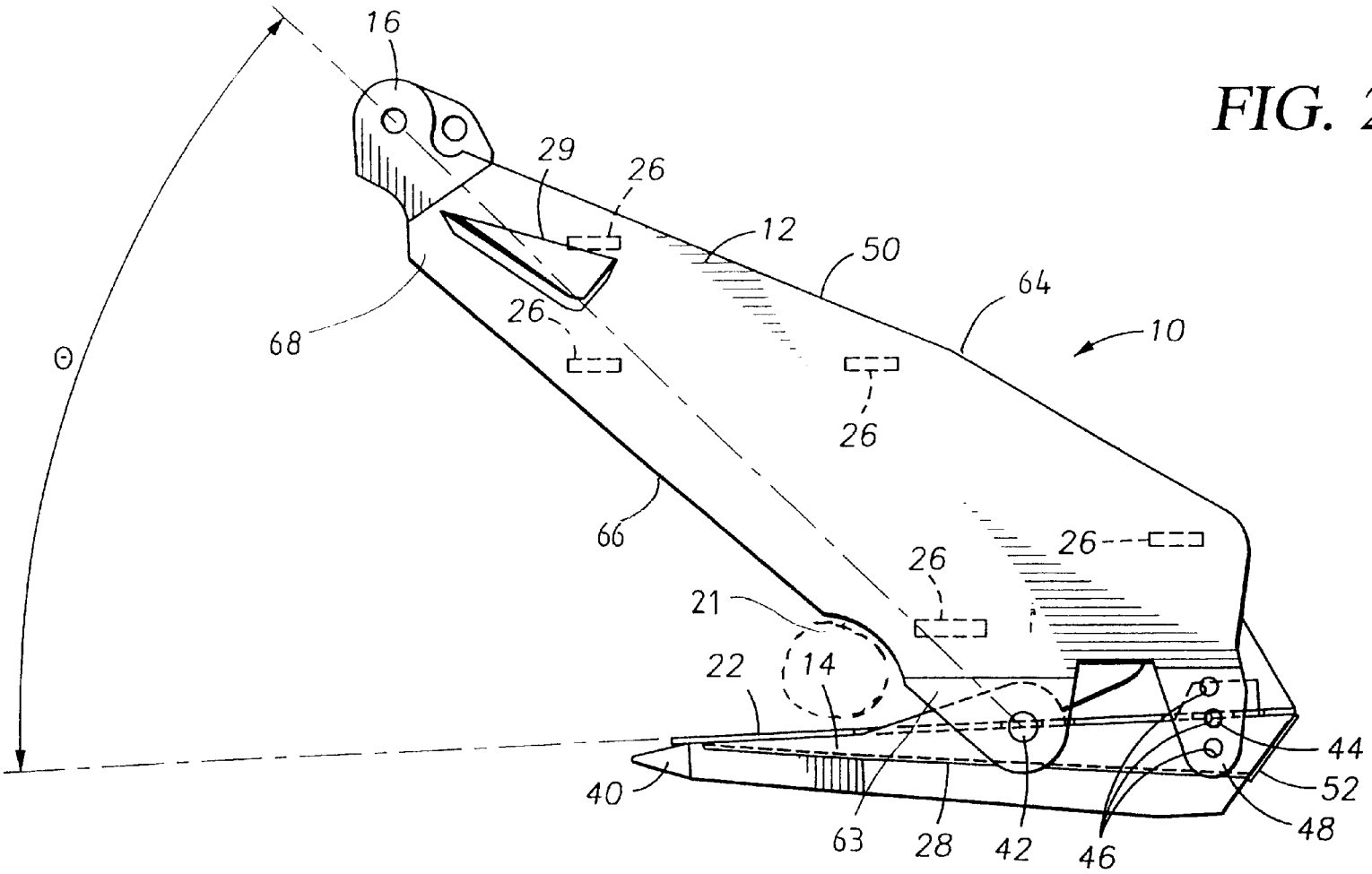
FIG. 2 is a side view of the anchor.

Now referring to FIG. 2, a partial cross-sectional side view of the anchor 10 is shown. The shank 12 and fluke 14 are pivotally adjustable about a pivot pin 42 by inserting an adjustment pin 44 into a given hole 46 through an adjustment plate 48 of the shank. It is preferred that the adjustment plate 48 include three adjustment holes 46 corresponding to angles Θ(theta), defined as the angle between the top fluke surface and a line extending between the eyelet 18 and the pivot pin 42, equal to about 30 degrees (for use in sand), about 40 degrees (for use in mud) and about 50 degrees (for use in soil). The most preferred angles are about 32, about 41 and about 50 degrees, respectively. All of the adjustments are made from the top surface 22 of the anchor flukes, enabling the angle Θ to be adjusted very quickly. Furthermore, the shank 12 may be completely detached from the fluke 14 for transport by removing the two pivot pins 42 and the two adjustment pins 44 from the two shank legs 24.

The shank 12 is preferably provided with an anchor depressor 29 near the lug end of the shank. The anchor depressor 29 provides more rapid penetration of the anchor 10 and adds stability to the anchor until the rear stabilizers 30 become engaged with the soil. The wing-like structure of the anchor depressors 29 also invert the anchor onto the back edge 50 of the shanks as it is being pulled onto the stern of an anchor handling vessel.

The anchor 10 also incorporates a tapered surface 52 along the back edge of the fluke 14. The tapered surface 52 allows a more gradual expansion of the soil behind the anchor which prevents the creation of a void. Because soil fills in behind the tapered surface 52 as the anchor 10 penetrates, the anchor passes through the soil more readily and smoothly.

Now referring to FIG. 3, a top view of the anchor shows the attachment of the shank legs 24 to the top surface 22 of the fluke 14. A rearwardly diverging passage (illustrated by arrows 54) is provided between the shank legs 24 to allow the smooth passage of soil as the anchor penetrates the soil in the forward direction (indicated by arrow 55). The fluke 14 includes an additional fluke point 56 and fluke tip 58 positioned to break up or loosen soil before it enters into the passage 54 and thereby decrease the likelihood that the passage 54 will become clogged. By loosing the soil, the fluke point 56 also increases the ease with which the anchor can penetrate soil and pass therethrough. Additionally, the fluke point 56 provides more surface area to the top surface 22 of the fluke, thereby directly increasing the holding power of the anchor.

In accordance one aspect of the invention, it is important that the shank legs 24 are pivotally attached to the fluke 22 along non-parallel, rearwardly diverging lines 60. Preferably, the shank legs 24 are rearwardly diverging along all points of the passage 54, enabling the soil to pass through the shank without significant obstruction. The only obstructions in the passage 54 are the stiffeners or struts 26 disposed between the shank legs 24 to strengthen the shank. However, the resistance to soil flow caused by the struts 26 is minimized by using narrow struts and placing them into different planes parallel to the top fluke surface 22 (See also FIG. 4).

Figure 4:
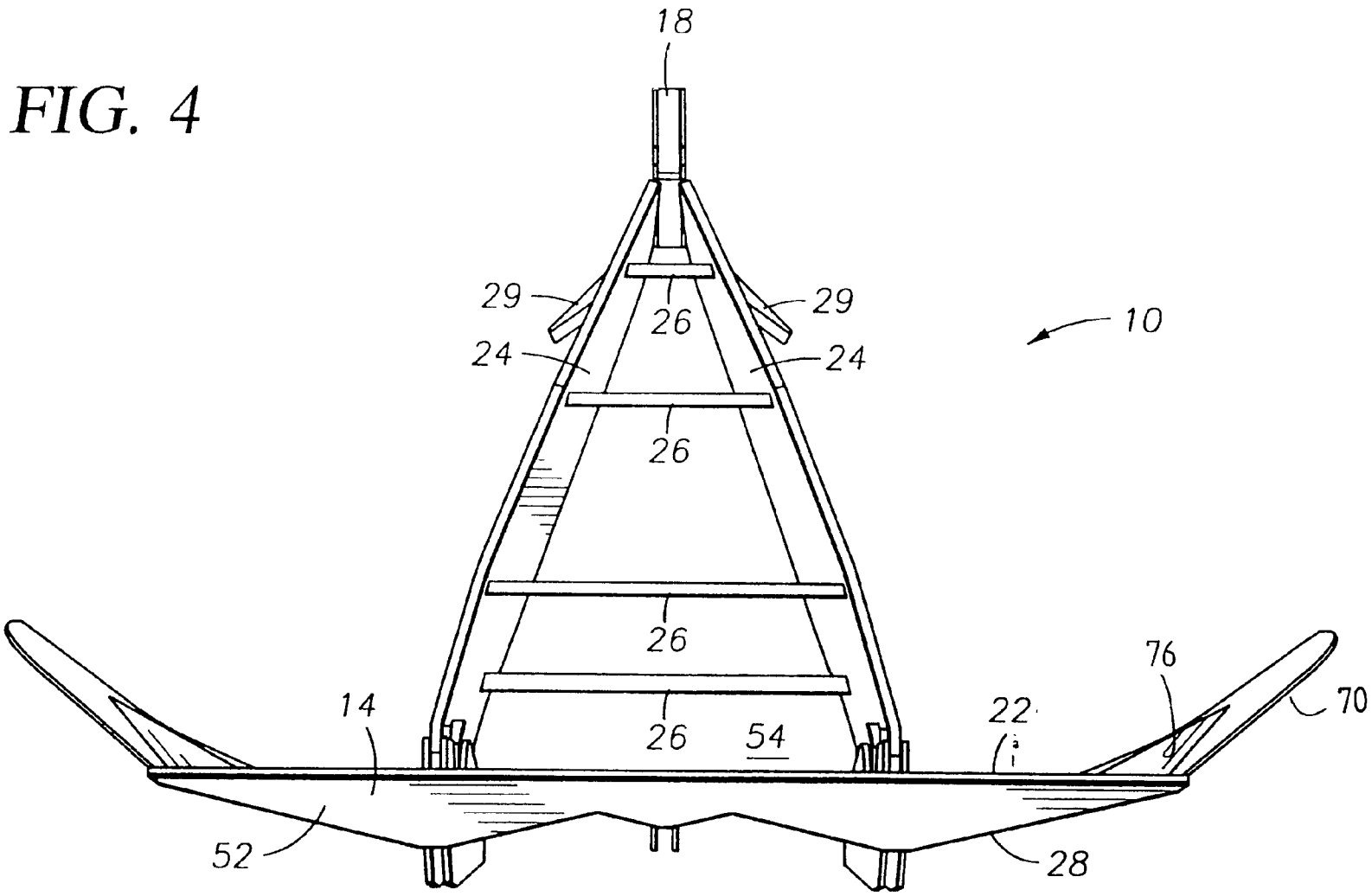
FIG. 4 is a back view of the anchor.

Now referring to FIG. 4, a back view of the anchor 10 is shown. The A-shaped passage 54 is defined generally by the space between the rearwardly diverging shank legs 24 and the top surface 22 of the fluke 14. Not only does the rearward divergence of the shank legs 24 allow easy passage of the soil, but it also provides forward facing surfaces 62 (See FIG. 3) against which the soil presses. As the anchor is pulled through the soil, the large shank surfaces 62 forces the soil to move aside and away from the anchor, thereby significantly increasing the total holding capacity of the anchor.

The flat top surface 22 and the tapered bottom surface 28 provide the fluke 14 with a stealth-like shape. The bottom surface 28 of the fluke 14 is tapered between each fluke point to provide certain advantages. First, the tapered bottom surfaces 28 allow for the use of triangular shaped reinforcing members 90 within the hollow fluke 14. These triangular members are stronger than rectangular members and resist compressional forces applied between the top and bottom fluke surfaces 22,28. Second, the tapering between fluke points allows the fluke to be made thinner than if the fluke had a constant thickness across the width of the fluke. Furthermore, the tapered surfaces between the fluke points provide more stability to the anchor before the stabilizers come in contact with the soil. Therefore, the stealth-shaped fluke provides faster, smoother and more controlled penetration; gives a much shorter drag distance; and increases the holding power due to the increase fluke area.

When the stealth-shaped fluke is combined with the rearwardly diverging shank legs, the overall performance of the anchor is between about 5 and about 12 percent greater holding capacity than available anchor designs of similar size and weight. This anchor is able to withstand positive pulling angles of 10° to 30° in most soils, which exceed other anchors now in use throughout the mooring industry. And while the anchor may be made any size, the drag embedment anchor preferably weighs between about 1,500 kgs and about 80,000 kgs.

The actual penetration depth and holding capacity of the anchor is dependent upon the soil characteristics in the vicinity of the mooring location. In fact, many types of soil structures may be present within one mooring location, requiring the testing of multiple soil samples representing each of the intended anchor locations. The performance of the anchor in each of these soils can be improved by adjusting the fluke angle. Using the correct fluke angle at all mooring locations is critical since inadequate holding power can be costly. Having information about the soils can also allow the drag distance to be reduced relative to that which would be otherwise experienced for those locations.

The anchor is preferably constructed of 52.3 DIN grade steel or higher giving a better structural integrity and cost efficiency. All welding processes should meet or exceed the guidelines set forth by GMAW and ASME V and VII. Anchors fabricated in accordance with the present invention, and as set out in the Figures, will provide holding powers approximately as set out in the table below:

Anchor Performance

| Soil Type | Sand | Clay | Mud |
|---|---|---|---|
| Fluke Angle | 32 degrees | 41 degrees | 50 degrees |
| Holding Power* | 55–65 | 36–50 | 30–36 |

*Multiples of the anchor weight.

In another aspect of the present invention, the anchor 10 has a fluke 14 having a longitudinal axis and a generally flat top surface 22 and a shank 12 having two legs 24 with first ends 63 coupled to the fluke. The legs have a front edge 66, and a back edge 64, and the front edge 66 of each leg forms a notch 27 therein at a spaced distance from the first end 63. The front edge of the leg 24 is substantially straight with the notch 27 cut out of the edge 66. The notch 27 is used to balance the anchor 10 on a cradle when the anchor 10 is pulled up from the water. Depending on the specific vessel, the notch 27 can have a generally arcuate shape such as a semi-circular or truncated triangular shape that faces the top surface of the fluke 14 so that the notch 27 matches the shape of the particular cradle being used. A portion of an anchor cradle is shown in dotted lines in FIG. 2. Preferably, each leg has a second end 68 and a mid-point between the first and second end and the notch 27 extends from near the first end 63 to near the mid-point on each leg.

The fluke 14 preferably has a pair of stabilizers 30 attached to the top surface. The stabilizers have a bottom face 70 extending away from the top surface 22 and a top face 72 that forms an angle with the bottom face so that the stabilizers are generally wedge shaped along the forward edge.

Figure 5A:
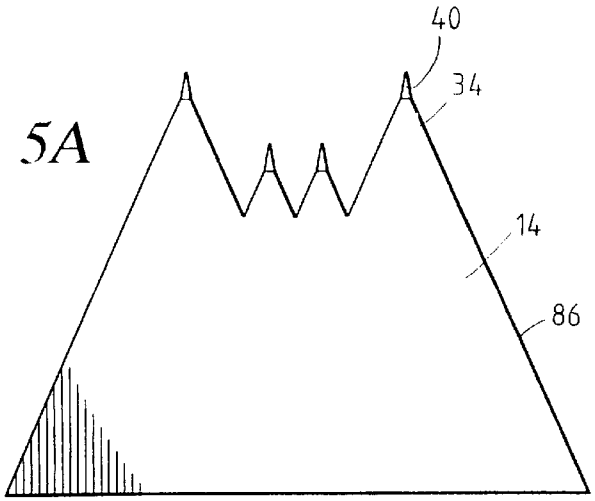
FIGS. 5A–C are perspective views of the fluke.
Figure 5B:
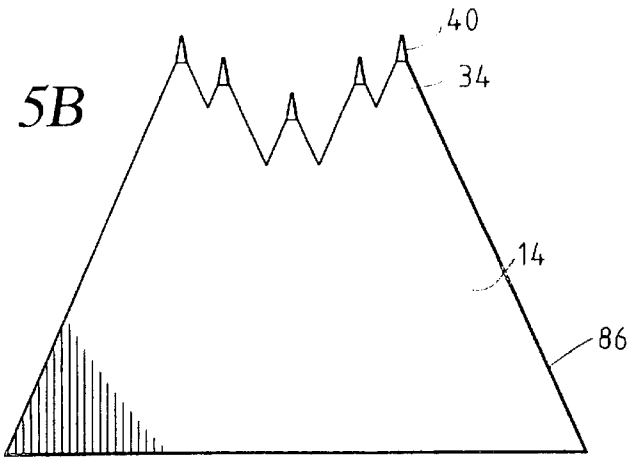
Figure 5C:
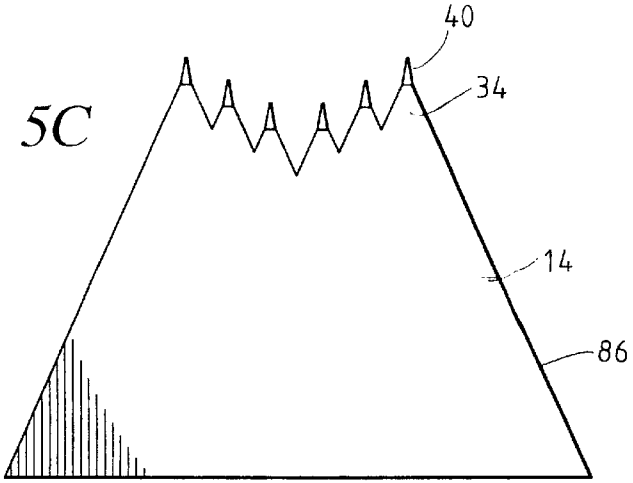

As shown in FIGS. 5A–C, the fluke can have at least one fluke point and at least one fluke tip attached to the point. Preferably, the fluke has more than one fluke tip and fluke point.

Figure 8:
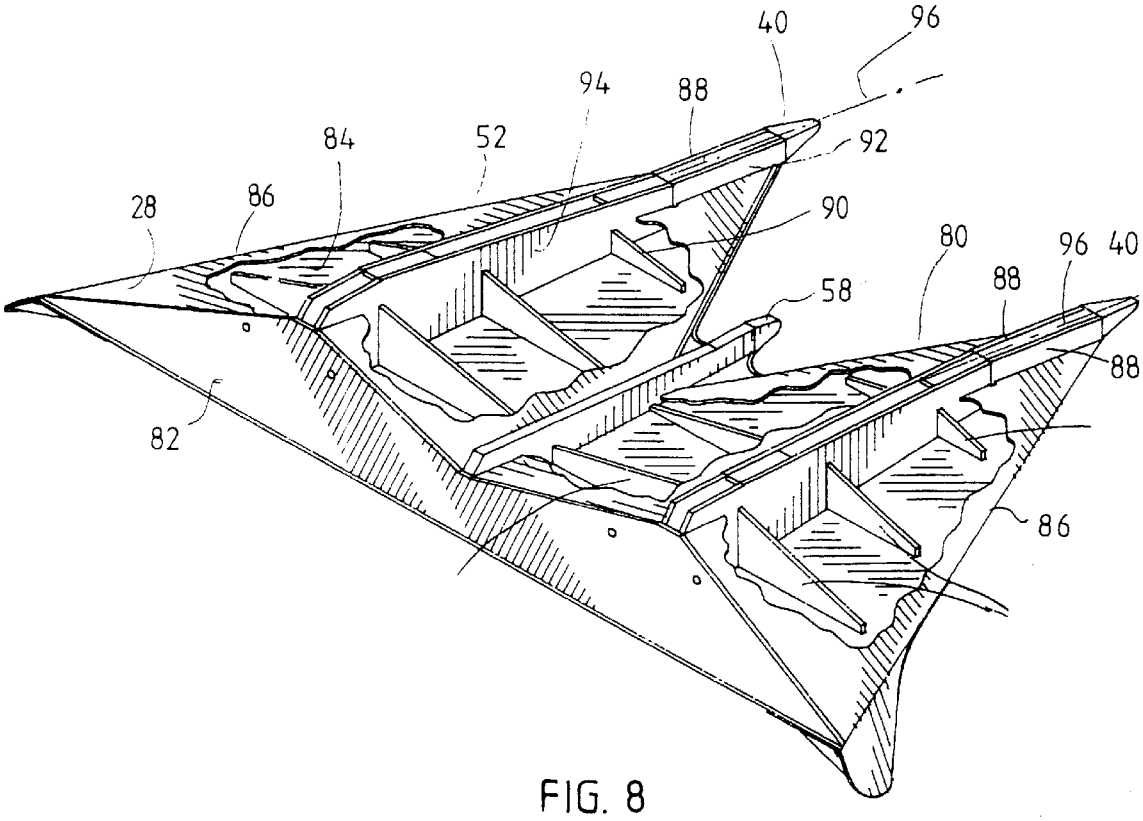
FIG. 8 is a partial cut away view of the bottom of the anchor.

Preferably, each fluke point and tip has a centerline 96 that is parallel to the longitudinal axis of the fluke 14, and the edge 86 of the fluke is tapered toward the centerline of each point (See FIG. 8). Each point is bisected by its centerline.

Figure 6:
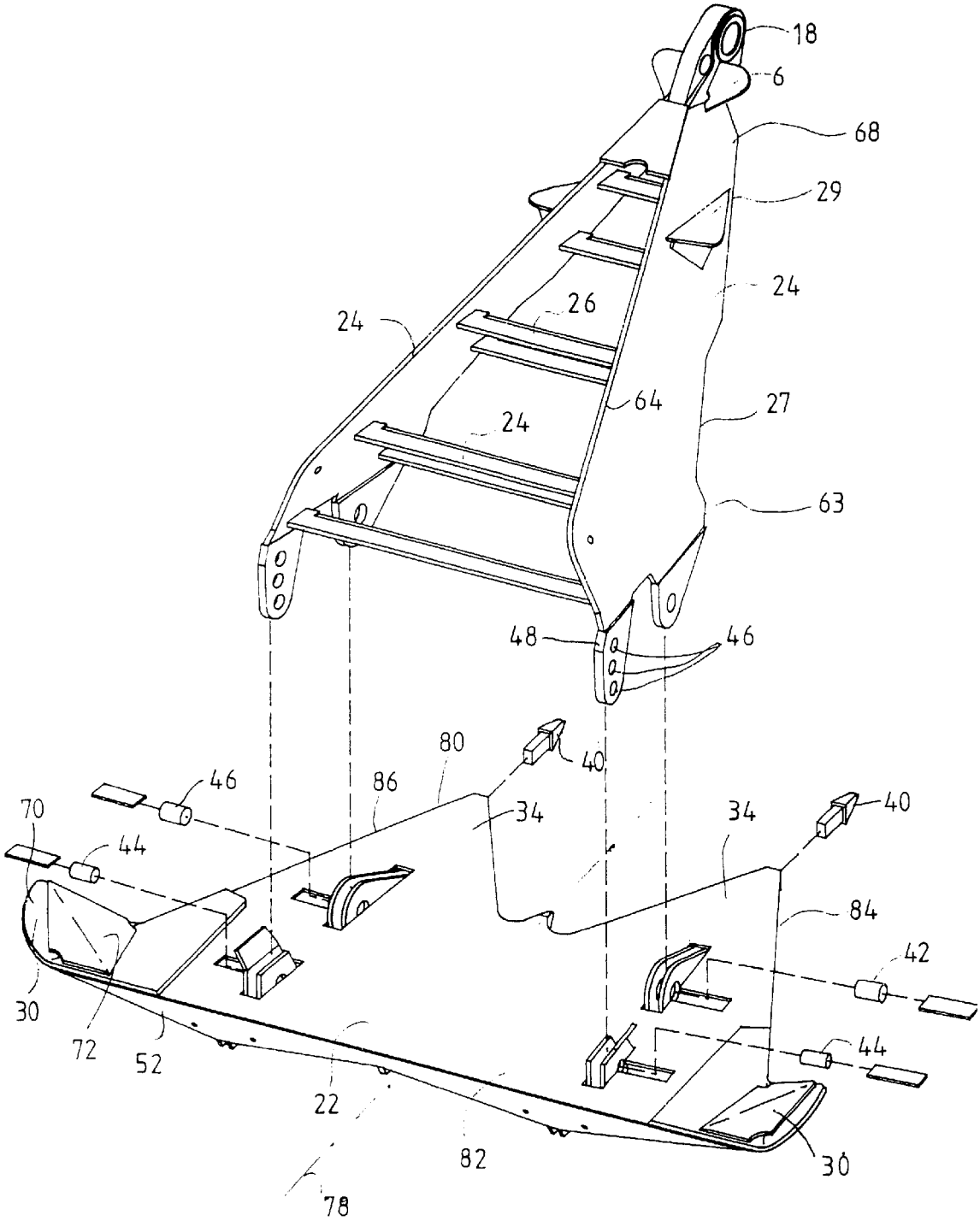
FIG. 6 is an expanded view of a drag embedment anchor of the present invention.
Figure 7:
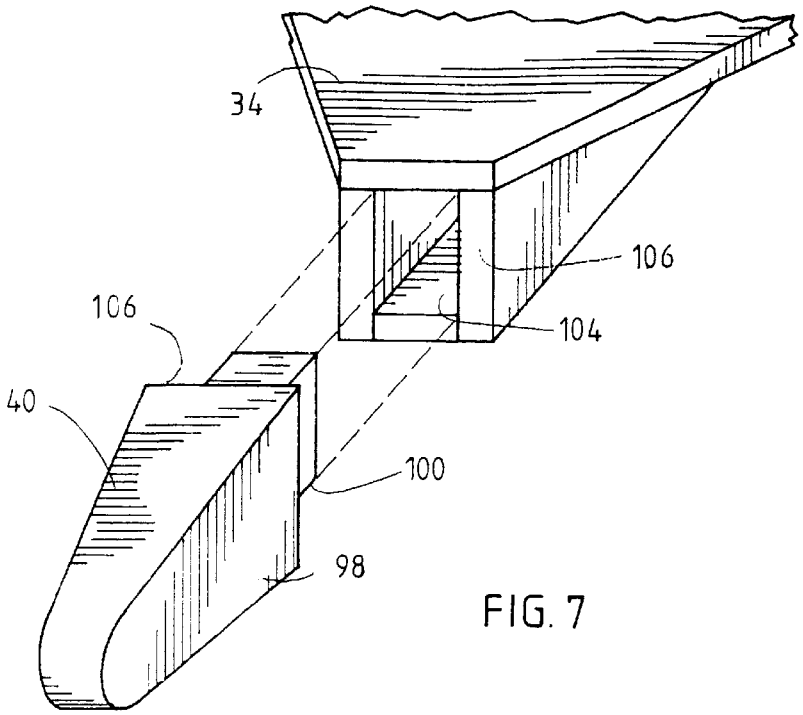
FIG. 7 is an exploded view of a fluke point and tip of the present invention.

Referring to FIGS. 6 and 7, a hollow forwardly tapering fluke 14 is provided with at least one fluke point 34 having at least one removable fluke tip 40 attached thereto. A shank 12 having a pair of legs 24 is coupled to the fluke 14. The fluke preferably has a longitudinal axis 78, a front end 80, a back end 82, a generally flat top portion 22 having an upper surface 22 and lower surface 84 and an edge 86. There are a plurality of longitudinally extending ribs 88 attached to the lower surface 84 and a tapered bottom portion 28 attached to the rib 88 and the edge 86 (See FIG. 8).

In order to provide internal support for the fluke, there is at least one triangular support member 90 attached to at least one rib 88 so that the triangular support member 90 tapers away from the rib 88 toward the lower surface 84 of the top portion 22. The triangular support member 90 can be welded to the lower surface 84 of the top portion 22 and the rib 88. Each of the ribs 88 may further have a first portion 92 adjacent to the front end 80 of the fluke and a second portion 94 adjacent to the back 52 of the fluke, so that the ribs are. forwardly tapering from the second portion 94 to the first portion 92. The first portion 92 of the rib 88 is preferably aligned with each fluke tip. Due to the angled nature of the shank legs, the first portion 92 of the ribs 88 are parallel to the longitudinal axis and the second portion 94 of the ribs 88 diverge away from the longitudinal axis toward the back end of the fluke.

Preferably, each fluke point and tip has a centerline 96 that is parallel to the longitudinal axis of the fluke 14, and the edge 86 of the fluke is tapered toward the ribs 88 (See FIG. 8). Each point is bisected by its centerline.

In a preferred embodiment, the fluke tips 40 have a pointed end 98 and a mating end 100, wherein the mating end 100 forms a shoulder 102 facing away from the pointed end 98, and each point 34 forms an opening 104 that is sized to closely receive the mating end 100 of the fluke tip (See FIG. 7). The opening 104 has an outer edge 106 and the shoulder 102 on the fluke tip abuts the edge 106 when the fluke point 34 and fluke tip 40 are made up (i.e., welded together). This allows the user to remove the fluke tips and replace them as they wear out, thus reducing the cost of repairing the points and/or replacing the anchor.

Generally, the fluke has a back edge that tapers from the bottom portion to the top portion toward the back end. The taper creates a back flow so the soil does not compact as it flows past the anchor. The fluke may also include a pair of stabilizers attached to the top surface having a wedge shaped profile extending away from the top surface of the fluke.

While the foregoing is directed to the preferred embodiment of the present invention, other and further embodiments of the invention may be devised without departing from the basic scope thereof, and the scope thereof is determined by the claims which follow.

What is claimed is:

1. An anchor capable of being supported on an anchor cradle comprising:

a fluke having a longitudinal axis, a generally flat top surface and a pair of stabilizers attached to the top surface having a bottom face extending away from the top surface and a top face that forms a wedge shape with the bottom face forming a pocket therebetween; and a shank having two legs with first ends coupled to the fluke, a front edge, and a back edge, wherein the front edge of each leg forms a notch therein at a spaced distance from the first end.

2. The anchor of claim 1, wherein the notch is shaped to contact the anchor cradle along a major portion of the notch.

3. The anchor of claim 1, wherein the front edge is substantially straight.

4. The anchor of claim 1, wherein each notch has a generally arcuate shape.

5. The anchor of claim 1, wherein each notch opens toward the top surface of the fluke.

6. The anchor of claim 1, wherein each notch has a generally semi-circular shape.

7. The anchor of claim 1, wherein each notch has a generally truncated triangular shape.

8. The anchor of claim 1, wherein each leg has a second end and a mid-point between the first and second end, wherein the notch extends from near the first end to near the mid-point on each leg.

9. The anchor of claim 1, wherein the fluke is hollow.

10. The anchor of claim 1, wherein the top face forms an angle of about 10 to 45 degrees with the bottom face of the stabilizer.

11. The anchor of claim 10, wherein the stabilizer forms a pair of openings between the top face and the bottom face of the stabilizer.

12. An anchor, comprising a hollow, forwardly tapering fluke having a longitudinal axis and at least one fluke point;

a removable fluke tip attached to the at least one fluke point, and a shank having a pair of legs coupled to the fluke.

13. The anchor of claim 12, wherein the fluke has a longitudinal axis, a front end, a back end;

a generally flat top portion having an upper and lower surface and an edge;

a plurality of longitudinally extending ribs attached to the lower surface; and a tapered bottom portion attached to the ribs and the edge.

14. The anchor of claim 12, wherein each fluke point and each fluke tip has a common centerline that is parallel to the longitudinal axis of the fluke, and the edge of the fluke is tapered toward the centerline of each point.

15. The anchor of claim 14, wherein each fluke point is bisected by the centerline.

16. The anchor of claim 12, wherein the fluke tips have a pointed end and a mating end, wherein the mating end forms a shoulder facing away from the pointed end, and each point forms an opening that is sized to closely receive the mating end of the fluke tip.

17. The anchor of claim 16, wherein the opening has an outer edge and the shoulder on the fluke tip abuts the edge when the fluke point and fluke tip are made up.

18. The anchor of claim 13, further comprising at least one triangular support member attached to at least one rib section, wherein the triangular support member tapers away from the rib section toward the lower surface of the top portion.

19. The anchor of claim 13, wherein each of the ribs have a first portion adjacent to the front end of the fluke and a second portion adjacent to the back of the fluke, wherein the ribs are forwardly tapering from the second portion to the first portion.

20. The anchor of claim 19, wherein the first portion of the ribs is aligned with each fluke point.

21. The anchor of claim 19, wherein the first portion of the ribs are parallel to the longitudinal axis and the second portion of the ribs diverge away from the longitudinal axis toward the back end of the fluke.

22. The anchor of claim 14, wherein one fluke tip is shorter than at least one other fluke tip.

23. The anchor of claim 13, wherein the fluke has a back edge that tapers from the bottom portion to the top portion toward the back end.

24. The anchor of claim 13, wherein the fluke includes a pair of stabilizers attached to the top surface having a bottom face extending away from the top surface and a wedge shaped top face.

25. The anchor of claim 24, wherein the top face forms an angle of about 10 to 45 degrees with the bottom face of the stabilizer.

26. The anchor of claim 24, wherein the stabilizer forms a pocket between the top face and the bottom face.

27. The anchor of claim 24, wherein the stabilizer forms a pair of openings between the top face and the bottom face of the stabilizer.

28. An anchor, comprising a hollow, forwardly tapering fluke having a longitudinal axis and at least two fluke points;

at least two fluke tips attached to the fluke points, one fluke tip being shorter than at least one other fluke tip, each fluke point and each fluke tip having a centerline that is parallel to the longitudinal axis of the fluke, the edges of the fluke being tapered toward respective centerlines; and a shank having a pair of legs coupled to the fluke.

29. The anchor of claim 28, wherein the fluke has a longitudinal axis, a front end, a back end;

a generally flat top portion having an upper and lower surface and an edge;

a plurality of longitudinally extending ribs attached to the lower surface; and a tapered bottom portion attached to the ribs and the edge.

30. The anchor of claim 29, further comprising at least one triangular support member attached to at least one rib section, wherein the triangular support member tapers away from the rib section toward the lower surface of the top portion.

31. The anchor of claim 29, wherein each of the ribs have a first portion adjacent to the front end of the fluke and a second portion adjacent to the back of the fluke, wherein the ribs are forwardly tapering from the second portion to the first portion.

32. The anchor of claim 31, wherein the first portion of the ribs is aligned with each fluke point.

33. The anchor of claim 31, wherein the first portion of the ribs are parallel to the longitudinal axis and the second portion of the ribs diverge away from the longitudinal axis toward the back end of the fluke.

* * * * *